US008500208B1

(12) United States Patent
Bentley

(10) Patent No.: US 8,500,208 B1
(45) Date of Patent: Aug. 6, 2013

(54) COAL CUTTER DRUM ASSEMBLY

(76) Inventor: Jerry Bentley, Virgie, KY (US)

( * ) Notice: Subject to any disclaimer, the term of this patent is extended or adjusted under 35 U.S.C. 154(b) by 0 days.

(21) Appl. No.: 13/460,038

(22) Filed: Apr. 30, 2012

Related U.S. Application Data

(60) Provisional application No. 61/479,997, filed on Apr. 28, 2011.

(51) Int. Cl.
*E21C 25/10* (2006.01)

(52) U.S. Cl.
USPC ..... 299/76

(58) Field of Classification Search
USPC ..... 299/64, 71, 75, 76, 82.1
See application file for complete search history.

(56) References Cited

U.S. PATENT DOCUMENTS

| | | | | |
|---|---|---|---|---|
| 2,415,217 | A | 2/1947 | Osgood | |
| 2,612,361 | A * | 9/1952 | Hagenbook | 299/85.1 |
| 2,670,190 | A * | 2/1954 | Cartlidge | 299/79.1 |
| 2,689,117 | A * | 9/1954 | Lindberg | 299/76 |
| 2,710,179 | A * | 6/1955 | Cartlidge | 299/85.1 |
| 2,730,344 | A * | 1/1956 | Cartlidge | 299/78 |
| 2,808,253 | A * | 10/1957 | Miller | 299/76 |
| 3,288,536 | A * | 11/1966 | Galis et al. | 299/64 |
| 3,726,563 | A * | 4/1973 | Galis | 299/15 |
| 3,860,291 | A | 1/1975 | Rauch et al. | |
| 5,112,111 | A | 5/1992 | Addington et al. | |
| 5,848,825 | A | 12/1998 | Antoline et al. | |
| 5,938,289 | A | 8/1999 | Antoline et al. | |
| 6,042,191 | A | 3/2000 | Antoline et al. | |
| 7,717,522 | B2 | 5/2010 | In't Hout et al. | |
| 7,721,869 | B2 | 5/2010 | In't Hout | |

* cited by examiner

*Primary Examiner* — Sunil Singh
(74) *Attorney, Agent, or Firm* — Stites & Harbison, PLLC; David W. Nagle, Jr.

(57) ABSTRACT

A coal cutter drum assembly includes a cutter drum having an inner diameter and mounted for rotation about a cutter drum shaft, along with multiple bit retainers secured to an external surface of the cutter drum, each retainer receiving a cutting bit. The coal cutter drum assembly further includes first and second bit and bearing retainer subassemblies, each of which is joined to the cutter drum and further joined to a sprocket that is used to rotate the cutter drum. A bearing supporting the cutter drum is positioned in each of the first and second bit and bearing retainer subassemblies, and each bearing has an outer diameter that exceeds the inner diameter of the cutter drum.

11 Claims, 5 Drawing Sheets

COAL CUTTER DRUM ASSEMBLY

CROSS-REFERENCE TO RELATED APPLICATIONS

The present application claims priority to U.S. Provisional Patent Application Ser. No. 61/479,997 filed on Apr. 28, 2011, the entire disclosure of which is incorporated herein by reference.

BACKGROUND OF THE INVENTION

The present invention is related to a coal cutter drum assembly.

FIGS. 1 and 2 are assembled and partially exploded views of a prior art coal cutter drum assembly 110 that is designed for installation on a highwall mining machine manufactured and distributed by Bucyrus International, Inc. of Milwaukee, Wis. This highwall mining machine is also known as the "Terex SHM" mining machine, as it was previously marketed and distributed by Terex Corporation and its predecessor-in-interest, Superior Highwall Miners, Inc. ("SHM") of Beckley, West Va. In any event, as shown in the views of FIGS. 1 and 2, the coal cutter drum assembly 110 includes a cutter drum 112 that is mounted for rotation around a cutter drum shaft 114 and relative to left and right shear arms 116, 118 that extend from the mining machine. Multiple bit retainers 120 are then secured to the external surface of the cutter drum 112 in a helical pattern, with each bit retainer 120 receiving and securing a cutting bit (not shown in FIGS. 1 and 2). To effectuate rotation of the cutter drum 112, at either end of the cutter drum is a sprocket 180, 182 that is adapted to receive a chain (not shown) from a drive system of the mining machine. Thus, in operation, the cutter drum 112 is advanced into a coal seam while rotating, and the cutting bits engage and cut coal from the coal seam, as described, for example, in U.S. Pat. Nos. 5,848,825; 5,938,289; and 6,042,191, each of which is assigned to Superior Highwall Miners, Inc. ("SHM") of Beckley, West Va. and incorporated herein by reference.

While the coal cutter drum assembly 110 shown in FIGS. 1 and 2 works for coal seams with a height of 30 inches or greater, many of the larger coal seams suitable for high wall mining have already been mined, at least those larger coal seams in the Appalachian coal mining region. Thus, many remaining coal seams have a height that is less than 30 inches. Since a coal seam has rock on the top of the seam and on the bottom of the seam, if the coal cutter drum assembly 110 described above was used to mine a smaller coal seam, the coal cutter drum assembly 110 would cut more rock than desired, contaminating the mined coal and slowing mining production since it takes longer to cut rock as compared to coal. Thus, to mine smaller coal seams without cutting and mixing adjacent rock into the mined coal and/or slowing production, it would be desirable to use a cutter drum 112 with a smaller diameter.

However, it is not possible to simply replace the cutter drum 112 of the coal cutter drum assembly 110 with a cutter drum having a smaller outer diameter. Specifically, highwall coal mining requires high-powered motors to rotate the cutter drum 112, and thus, large-diameter bearings are required to support the cutter drum 112 as it is driven by the motors. For example, as shown in FIG. 2, in one prior art construction, roller bearings 170, 172 are positioned on either end of the cutter drum 112. In this example, the outer rings or races for each bearing 170, 172 are fit inside of the cutter drum 112, i.e., within the tube that forms the body of the cutter drum 112. The inner rings carrying the rollers are then mounted to the cutter drum shaft 114.

Because of such positioning of the bearings 170, 172, the size of the cutter drum 112 is limited by the size of the bearings that are required to support the cutter drum 112 as it is driven. For example, if the required bearings have a 10-inch outside diameter, the tube that forms the body of the cutter drum 112 would have to have an outer diameter of approximately 13 inches—with a 10-inch inner diameter for the bearings and a 1.5-inch wall thickness. Then, once the bit retainers 120 are secured to the external surface of the cutter drum 112, the cutting bits would extend approximately 7 inches on each side of the cutter drum 112, which is necessary to allow the mined coal to flow over the cutter drum 112 to the cutter conveying augers (not shown) and clear the mined coal from the cutter drum area. In other words, once the bit retainers 120 and associated cutting bits are secured to the external surface of the cutter drum 112, the total cutter drum diameter would be at least 27 inches. It would be virtually impossible to cleanly mine a coal seam with a height that is less than 30 inches using such a cutter drum assembly.

Finally, although not critical to an understanding of the present invention, to complete the description of FIG. 2, it should be noted that there is a first pair of face seals 174 positioned at one end of the cutter drum 112 and a second pair of face seals 176 positioned at an opposite end of the cutter drum 112. One of the rubber O-rings with one half of the first pair of face seals 174 is fit into the shear arm 116, while the other half of the first pair of face seals 174 is fit into the sprocket 180. Similarly, one end of the rubber O-rings with one half of the second pair of face seals 176 is fit into the shear arm 118, while the other half of the second pair of face seals 176 is fit into the sprocket 182. Thus, once assembled, these pairs of face seals 174, 176 prevent leakage of oil from the cutter drum 112.

SUMMARY OF THE INVENTION

The present invention is a coal cutter drum assembly, and, more particularly, a coal cutter drum assembly that includes a cutter drum with a smaller diameter, but still accommodates the larger bearings that are required to support the cutter drum as it is driven.

An exemplary coal cutter drum assembly made in accordance with the present invention includes a cutter drum. Multiple bit retainers are then secured to the external surface of the cutter drum, with each bit retainer receiving and securing a cutting bit. The coal cutter drum assembly further includes first and second bit and bearing retainer subassemblies at either end of the cutter drum. The first bit and bearing retainer subassembly includes a pair of bit and bearing retainers at one end of the cutter drum, and the second bit and bearing retainer subassembly includes a second pair of bit and bearing retainers at the opposite end of the cutter drum. Each bit and bearing retainer has an annular construction, defining a cylindrical inner cavity that is adapted to receive and accommodate a bearing. Each bit and bearing retainer further includes two holders that are secured to the external surface of the bit and bearing retainer and positioned approximately 180° from one another. Each of these holders is adapted to receive and secure a cutting bit and associated bit sleeve.

At one end of the cutter drum, one bit and bearing retainer of the first pair is welded or otherwise joined to a first sprocket that is used to rotate the cutter drum. The other bit and bearing retainer of the first pair is welded or otherwise joined to the cutter drum. Then, the bit and bearing retainers of the first pair are secured to one another. Similarly, at the opposite end of the cutter drum, one bit and bearing retainer of the second pair is welded or otherwise joined to a second sprocket that is used to rotate the cutter drum. The other bit and bearing retainer of the second pair is welded or otherwise joined to the cutter drum. Then, the bit and bearing retainers of the second pair are secured to one another.

The required bearings are positioned in and extend between the inner cavities defined by the respective first and second pairs of bit and bearing retainers. Since the bearings are now located outside of the tube that forms the body of the cutter drum, the inner diameter of the cutter drum is no longer a limitation, and bearings can be used that have an outer diameter that exceeds the inner diameter of the cutter drum.

DETAILED DESCRIPTION OF THE INVENTION

The present invention is a coal cutter drum assembly, and, more particularly, a coal cutter drum assembly that includes a cutter drum with a smaller diameter, but still accommodates the larger bearings that are required to support the cutter drum as it is driven.

Figure 4:
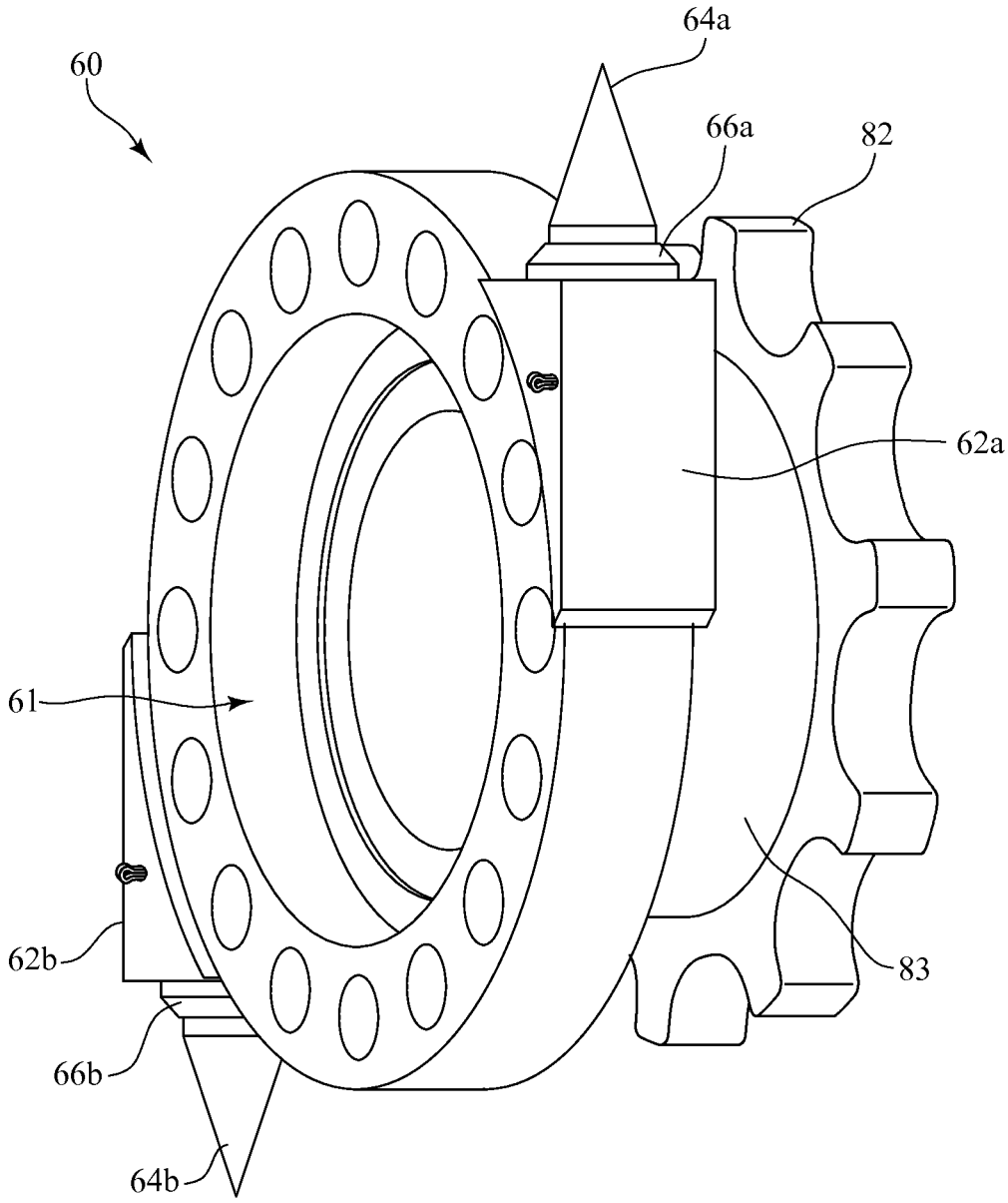
FIG. 4 is a perspective view of one pair of bit and bearing retainers of the exemplary cutter drum assembly of FIG. 3.
Figure 5:
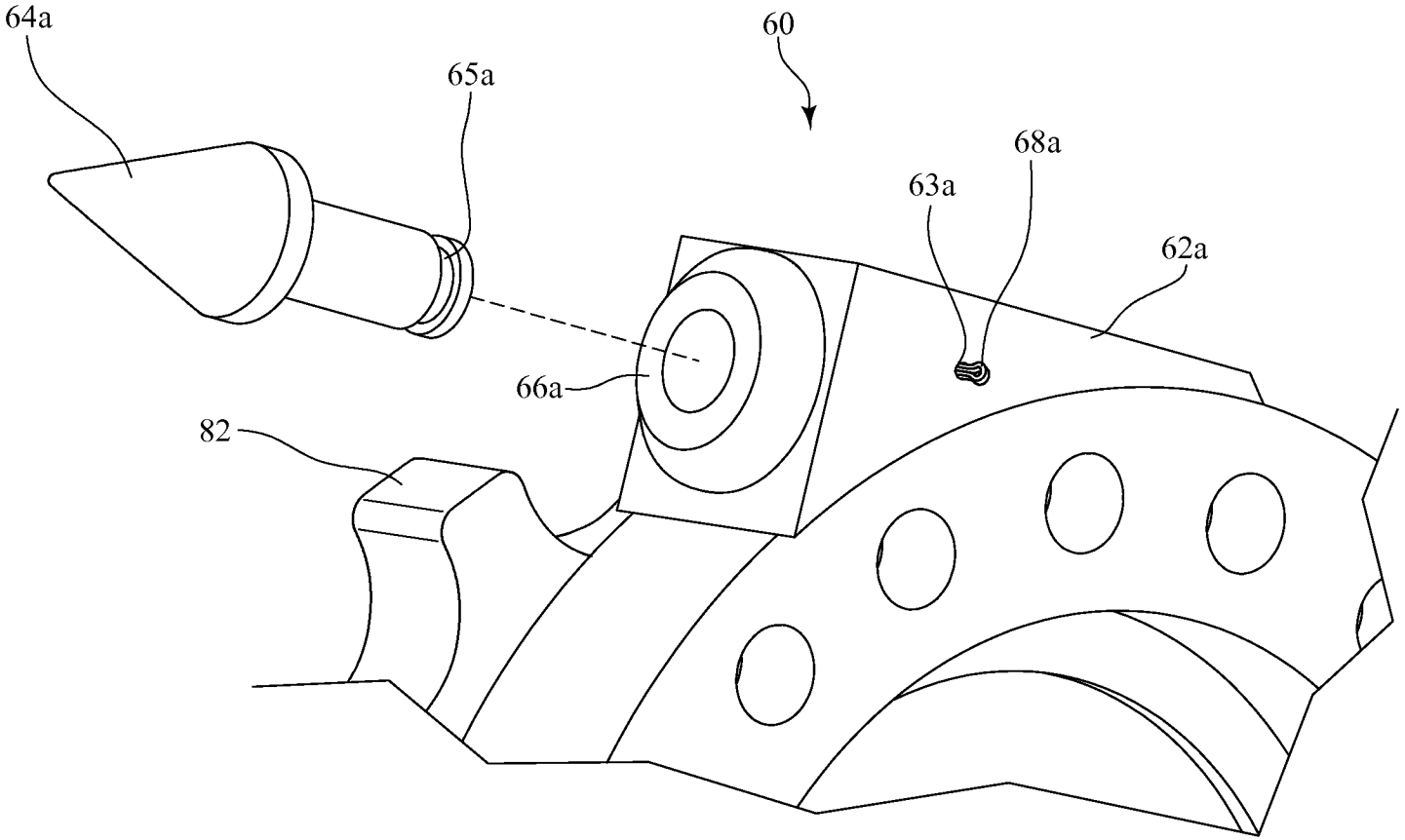
FIG. 5 is an enlarged and partially exploded perspective view of one of the holders, along with a cutting bit and associated bit sleeve of the exemplary cutter drum assembly of FIG. 3.
Figure 6:
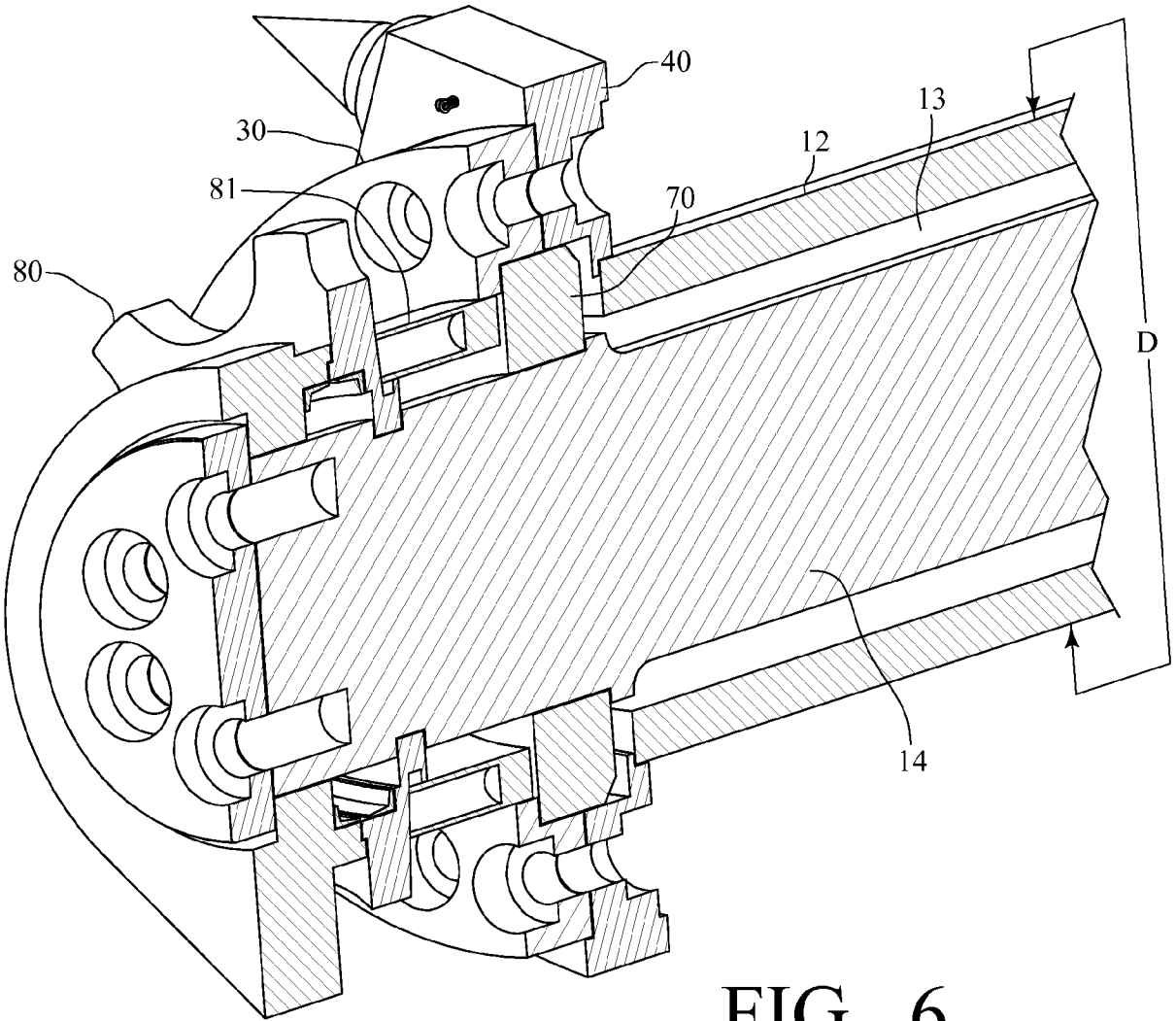
FIG. 6 is a partial sectional view of the exemplary cutter drum assembly of FIG. 3.

Referring now to FIGS. 3-6, an exemplary coal cutter drum assembly 10 made in accordance with the present invention includes a cutter drum 12 that is mounted for rotation around a cutter drum shaft 14 and relative to left and right shear arms 16, 18 that extend from a mining machine. Furthermore, as best shown in FIG. 6 and similar to prior art constructions, there is an oil space 13 separating the cutter drum 12 from the cutter drum shaft 14. As with prior art constructions, and as discussed above, multiple bit retainers 20 are then secured to the external surface of the cutter drum 12 in a helical pattern, with each bit retainer 20 receiving and securing a cutting bit 22. However, unlike prior art constructions, the coal cutter drum assembly 10 of the present invention includes first and second bit and bearing retainer subassemblies at either end of the cutter drum 12. In this exemplary embodiment, the first bit and bearing retainer subassembly includes a pair of bit and bearing retainers 30, 40 at one end of the cutter drum 12, and the second bit and bearing retainer subassembly includes a second pair of bit and bearing retainers 50, 60 at the opposite end of the cutter drum 12.

FIGS. 4 and 5 illustrate one of the bit and bearing retainers 60. As shown, the bit and bearing retainer 60 has an annular construction, defining a cylindrical inner cavity 61 that is adapted to receive and accommodate a bearing, which is indicated by reference numeral 70 in FIG. 6.

Referring still to FIGS. 4 and 5, the bit and bearing retainer 60 further includes two holders (or lugs) 62*a*, 62*b* that are secured to the external surface of the bit and bearing retainer 60 and positioned approximately 180° from one another. Each of these holders 62*a*, 62*b* is adapted to receive and secure a cutting bit 64*a*, 64*b* and associated bit sleeve 66*a*, 66*b*. In this exemplary embodiment, and as best shown in FIG. 5, each holder 62*a* includes an internal cavity that receives the bit sleeve 66*a*, and the cutting bit 64*a* is then inserted into the bit sleeve 66*a*. In order to secure the cutting bit 64*a*, a locking pin 68*a* may be inserted through a hole 63*a* defined through the holder 62*a* and into the internal cavity of the holder 62*a* where it engages a circumferential groove 65*a* at the distal end of the cutting bit 64*a*.

Referring again to FIG. 3 and the sectional view of FIG. 6, each of the bit and bearing retainers 30, 40, 50, 60 has a substantially identical construction. At one end of the cutter drum 12, the bit and bearing retainer 30 is welded or otherwise joined to the first sprocket 80 that is used to rotate the cutter drum 12. In this exemplary embodiment, the bit and bearing retainer 30 is welded or otherwise joined to a sleeve member 81 that extends from the first sprocket 80. The other bit and bearing retainer 40 is welded or otherwise joined to the cutter drum 12. Then, the bit and bearing retainer 30 and the bit and bearing retainer 40 are secured to one another with bolts (not shown) or similar fasteners, with the respective holders for the cutting bits offset from one another by 90°. Similarly, at the opposite end of the cutter drum 12, the bit and bearing retainer 60 is welded or otherwise joined to the second sprocket 82 that is used to rotate the cutter drum 12 (for example, via a sleeve member 83 that extends from the second sprocket 82). The bit and bearing retainer 50 is welded or otherwise joined to the cutter drum 12. Then, the bit and bearing retainer 60 and the bit and bearing retainer 50 are secured to one another with bolts or similar fasteners, with the respective holders for the cutting bits offset from one another by 90°.

Referring now to FIG. 6, the bearing 70 is positioned in and extends between the inner cavities defined by the bit and bearing retainers 30, 40. Of course, although not shown in FIG. 6, a substantially identical bearing is also positioned in the inner cavities defined by the bit and bearing retainers 50, 60 at the opposite end of the cutter drum 12. For example, appropriate bearings for this purpose include tapered roller bearings manufactured by The Timken Company of Canton, Ohio, including Part No. 99100 (cup or outer ring) and Part No. 99300 (cone or inner ring). Such bearings are available through various distributors, including, for example, Motion Industries, Inc. of Birmingham, Ala.

Since the bearings 70 are now located outside of the tube that forms the body of the cutter drum 12, the inner diameter of the cutter drum 12 is no longer a limitation. In other words, bearings can be used that have an outer diameter that exceeds the inner diameter of the cutter drum.

Figure 1:
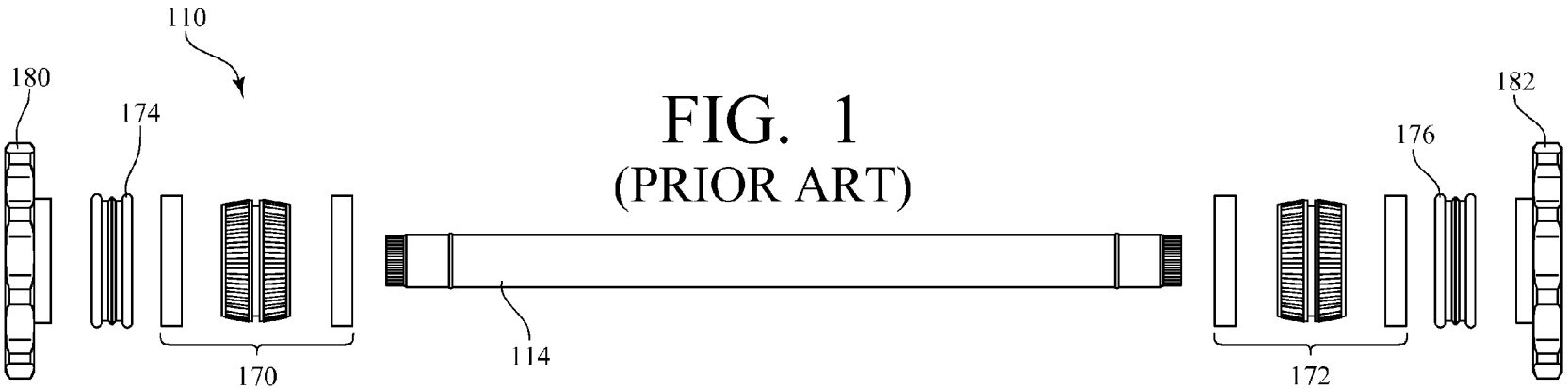
FIG. 1 (PRIOR ART)
FIG. 1 is a view of a prior art cutter drum assembly.
Figure 2:
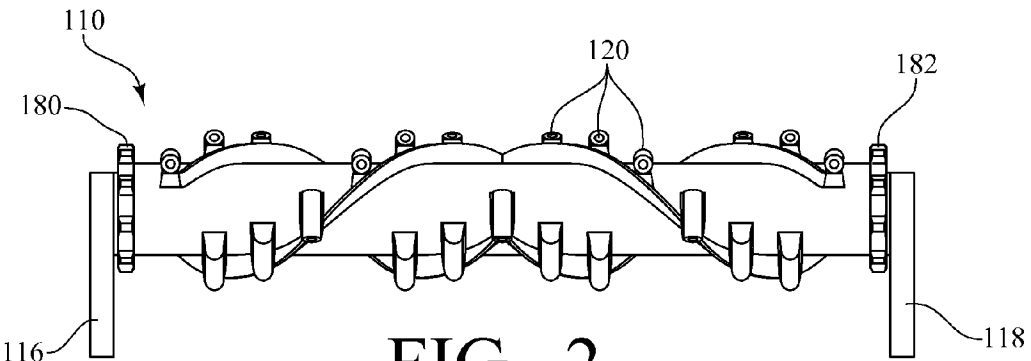
FIG. 2 (PRIOR ART)
FIG. 2 is a partial exploded view of the prior art cutter drum assembly of FIG. 1.
Figure 3:
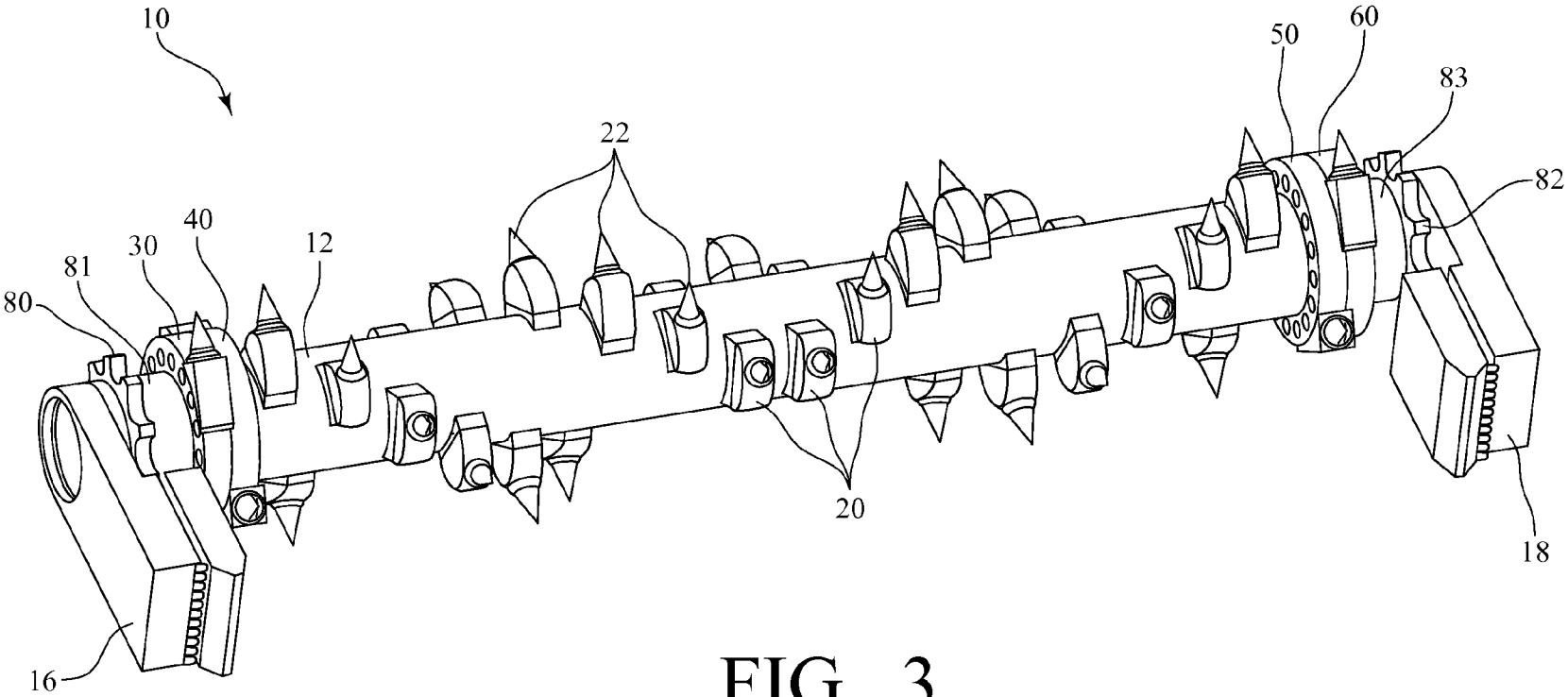
FIG. 3 is a perspective view of an exemplary cutter drum assembly made in accordance with the present invention.

For example, as compared to the prior art construction described above with reference to FIGS. 1 and 2 and the sectional view of FIG. 6, the outer diameter, D, of a cutter drum of a coal cutter drum assembly made in accordance with the present invention could be reduced from 13 inches to 6 inches. Assuming that the cutting bits still extend approximately 7 inches on each side of the cutter drum, the total cutter drum diameter would now be 20 inches. This small-diameter cutter drum would thus allow for the ready mining of coal seams with a height of less than 30 inches.

One of ordinary skill in the art will recognize that additional embodiments are possible without departing from the teachings of the present invention or the scope of the claims which follow. This detailed description, and particularly the specific details of the exemplary embodiment disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A coal cutter drum assembly, comprising:

a cutter drum having an inner diameter and mounted for rotation about a cutter drum shaft;

multiple bit retainers secured to an external surface of the cutter drum;

multiple cutting bits, each such cutting bit being received in one of the multiple bit retainers;

a first bit and bearing retainer subassembly joined to the cutter drum at one end of the cutter drum and further joined to a first sprocket that is used to rotate the cutter drum;

a first bearing supporting the cutter drum, said first bearing being positioned in the first bit and bearing retainer subassembly, and said first bearing having an outer diameter that exceeds the inner diameter of the cutter drum;

a second bit and bearing retainer subassembly joined to the cutter drum at an opposite end of the cutter drum and further joined to a second sprocket that is used to rotate the cutter drum; and a second bearing supporting the cutter drum, said second bearing being positioned in the second bit and bearing retainer subassembly, and said second bearing having an outer diameter that exceeds the inner diameter of the cutter drum.

2. The coal cutter drum assembly as recited in claim 1, wherein the first bit and bearing retainer subassembly includes one or more holders, each holder receiving a cutting bit, and wherein the second bit and bearing retainer subassembly includes one or more holders, each holder receiving a cutting bit.

3. The coal cutter drum assembly as recited in claim 1, wherein the first bit and bearing retainer subassembly includes a first pair of bit and bearing retainers that are secured to one another, each of the bit and bearing retainers of the first pair having an annular construction and defining a cylindrical inner cavity, wherein the first bearing is positioned in and extends between the inner cavities defined by the bit and bearing retainers of the first pair, and wherein one of the first pair of bit and bearing retainers is joined to the first sprocket, and another of the first pair of bit and bearing retainers is joined to the cutter drum.

4. The coal cutter drum assembly as recited in claim 3, wherein the second bit and bearing retainer subassembly includes a second pair of bit and bearing retainers that are secured to one another, each of the bit and bearing retainers of the second pair having an annular construction and defining a cylindrical inner cavity, wherein the second bearing is positioned in and extends between the inner cavities defined by the bit and bearing retainers of the second pair, and wherein one of the second pair of bit and bearing retainers is joined to the second sprocket, and another of the second pair of bit and bearing retainers is joined to the cutter drum.

5. The coal cutter drum assembly as recited in claim 4, wherein each of the bit and bearing retainers of the first pair includes two holders that are secured to an external surface of the respective bit and bearing retainers and positioned approximately 180° from one another, and wherein each of the bit and bearing retainers of the second pair includes two holders that are secured to an external surface of the respective bit and bearing retainer and positioned approximately 180° from one another.

6. The coal cutter drum assembly as recited in claim 5, wherein each of the holders receives and secures a cutting bit.

7. The coal cutter drum assembly as recited in claim 6, wherein each of the holders includes an internal cavity that receives a bit sleeve, and wherein the cutting bit is inserted into the bit sleeve and is secured by a locking pin.

8. A coal cutter drum assembly, comprising:

a cutter drum having an inner diameter and mounted for rotation about a cutter drum shaft;

multiple bit retainers secured to an external surface of the cutter drum;

multiple cutting bits, each such cutting bit being received in one of the multiple bit retainers;

a first pair of bit and bearing retainers at one end of the cutter drum, each of the bit and bearing retainers of the first pair having an annular construction and defining a cylindrical inner cavity, and each of the bit and bearing retainers of the first pair including one or more holders that are secured to an external surface of the bit and bearing retainer and receive a cutting bit;

a first bearing supporting the cutter drum, said first bearing being positioned in and extending between the inner cavities defined by the bit and bearing retainers of the first pair, wherein one of the first pair of bit and bearing retainers is joined to a first sprocket that is used to rotate the cutter drum, wherein another of the first pair of bit and bearing retainers is joined to the cutter drum, and wherein the bit and bearing retainers of the first pair are secured to one another;

a second pair of bit and bearing retainers at an opposite end of the cutter drum, each of the bit and bearing retainers of the second pair having an annular construction and defining a cylindrical inner cavity, and each of the bit and bearing retainers of the second pair including one or more holders that are secured to an external surface of the bit and bearing retainer and receive a cutting bit; and a second bearing supporting the cutter drum, said second bearing being in and extending between the inner cavities defined by the bit and bearing retainers of the second pair, wherein one of the second pair of bit and bearing retainers is joined to a second sprocket that is used to rotate the cutter drum, wherein another of the second pair of bit and bearing retainers is joined to the cutter drum, and wherein the bit and bearing retainers of the second pair are secured to one another.

9. The coal cutter drum assembly as recited in claim 8, wherein each of the bit and bearing retainers of the first pair includes two holders that are secured to an external surface of the respective bit and bearing retainer and positioned approximately 180° from one another, and wherein each of the bit and bearing retainers of the second pair includes two holders that are secured to an external surface of the respective bit and bearing retainer and positioned approximately 180° from one another.

10. The coal cutter drum assembly as recited in claim 9, wherein each of the holders receives and secures a cutting bit.

11. The coal cutter drum assembly as recited in claim 10, wherein each of the holders includes an internal cavity that receives a bit sleeve, and the cutting bit is inserted into the bit sleeve and is secured by a locking pin.

* * * * *